US009230758B2

(12) United States Patent
Favreau et al.

(10) Patent No.: US 9,230,758 B2
(45) Date of Patent: Jan. 5, 2016

(54) WIRE-FUSE CIRCUIT-BREAKER PROVICED WITH A FUSEHOLDER AND A FUSE-BREAKER OF IMPROVED DRIVE AND OPERATION SAFETY

(75) Inventors: Pierre Favreau, Ahuntsic (CA); Jamie Roy, Quebec (CA); Goran Milisav, Montréal (CA); Nicolas Astruc, Montpellier (FR)

(73) Assignee: SCHNEIDER ELECTRIC CANADA INC. (CA)

( * ) Notice: Subject to any disclaimer, the term of this patent is extended or adjusted under 35 U.S.C. 154(b) by 1050 days.

(21) Appl. No.: 13/113,628

(22) Filed: May 23, 2011

(65) Prior Publication Data

US 2011/0291793 A1 Dec. 1, 2011

(30) Foreign Application Priority Data

May 25, 2010 (FR) ..... 10 54033

(51) Int. Cl.

| | |
|---|---|
| ***H01H 71/10*** | (2006.01) |
| ***H01H 31/12*** | (2006.01) |
| *H01H 85/36* | (2006.01) |
| *H01H 85/38* | (2006.01) |
| *H01H 85/42* | (2006.01) |
| *H01H 85/43* | (2006.01) |

(52) U.S. Cl.

CPC ..... *H01H 31/127* (2013.01); *H01H 85/36* (2013.01); *H01H 85/38* (2013.01); *H01H 85/42* (2013.01); *H01H 85/43* (2013.01); *Y10T 29/49002* (2015.01)

(58) Field of Classification Search

CPC ..... H01H 85/42; H01H 85/43; H01H 31/127; H01H 85/36; H01H 85/38; Y10T 29/49002

USPC ..... 337/171

See application file for complete search history.

(56) References Cited

U.S. PATENT DOCUMENTS

| | | | | | |
|---|---|---|---|---|---|
| 2,088,152 | A | * | 7/1937 | Carlisle | 337/169 |
| 2,100,413 | A | * | 11/1937 | Steinmayer | 337/240 |
| 2,178,650 | A | * | 11/1939 | Schultz | 337/171 |
| 2,212,633 | A | * | 8/1940 | Bodendieck | 337/170 |
| 2,247,700 | A | * | 7/1941 | Ramsey | 337/288 |
| 2,263,513 | A | * | 11/1941 | Meyer | 337/190 |
| 2,269,372 | A | * | 1/1942 | Johnson | 337/170 |
| 2,274,898 | A | * | 3/1942 | Johnson | 337/175 |
| 2,291,647 | A | * | 8/1942 | Ramsey | 337/287 |
| 2,305,996 | A | * | 12/1942 | Schultz et al. | 337/286 |

(Continued)

FOREIGN PATENT DOCUMENTS

| | | |
|---|---|---|
| FR | 1153541 | 5/1958 |

*Primary Examiner* — Anatoly Vortman
*Assistant Examiner* — Jacob Crum
(74) *Attorney, Agent, or Firm* — Baker Hostetler

(57) ABSTRACT

The invention relates to a mechanical assembly for a wire-fuse circuit-breaker (1) provided with a fuseholder (2) and a drive lever (3) adapted to be actuated by an operator and to actuate a lever for breaking the fuse wire.

According to the invention, the direction of pivoting of the drive lever is the opposite of the direction of pivoting of the fuseholder tube and the mounting of the parts leaves sufficiently clear the area in the vicinity of the open lower end of the fuse-holder tube to allow gases produced by breaking the fuse wire to exhaust without disturbing the flow thereof. This makes a wire-fuse circuit-breaker safe to drive and safe in operation. The invention also relates to a method of renovating an existing wire-fuse circuit-breaker.

9 Claims, 5 Drawing Sheets

(56) References Cited

U.S. PATENT DOCUMENTS

| | | | | | |
|---|---|---|---|---|---|
| 2,310,466 | A | * | 2/1943 | Schultz et al. | 337/157 |
| 2,362,314 | A | * | 11/1944 | Schultz et al. | 337/156 |
| 2,365,113 | A | * | 12/1944 | Schultz | 337/170 |
| 2,386,886 | A | * | 10/1945 | Earle et al. | 337/281 |
| RE22,747 | E | * | 4/1946 | Schultz et al. | 337/156 |
| 2,429,347 | A | * | 10/1947 | Earle et al. | 337/281 |
| 2,512,498 | A | * | 6/1950 | Linde et al. | 337/190 |
| 2,532,258 | A | * | 11/1950 | Lincks | 335/43 |
| 2,532,259 | A | * | 11/1950 | Lincks | 335/28 |
| 2,537,348 | A | * | 1/1951 | Hubbard et al. | 337/223 |
| 2,574,400 | A | * | 11/1951 | Lesher | 337/223 |
| 2,574,401 | A | * | 11/1951 | Lesher | 337/180 |
| 2,581,954 | A | * | 1/1952 | Hubbard et al. | 337/170 |
| 2,584,586 | A | * | 2/1952 | Hubbard | 337/170 |
| 2,611,054 | A | * | 9/1952 | Hubbard | 337/177 |
| 2,629,794 | A | * | 2/1953 | Hubbard et al. | 337/170 |
| 2,630,508 | A | * | 3/1953 | Meisenheimer et al. | 337/157 |
| 2,655,576 | A | * | 10/1953 | Milne et al. | 337/180 |
| 2,672,539 | A | * | 3/1954 | Steinmayer | 337/175 |
| 2,674,673 | A | * | 4/1954 | Gilliland | 337/179 |
| 2,689,284 | A | * | 9/1954 | Hill | 337/173 |
| 2,735,911 | A | * | 2/1956 | Sant | 337/157 |
| 2,986,619 | A | * | 5/1961 | McCloud | 337/223 |
| 3,177,317 | A | * | 4/1965 | McCloud | 337/223 |
| 3,184,567 | A | * | 5/1965 | Gussow | 337/156 |
| 3,218,517 | A | * | 11/1965 | Sankey | 361/125 |
| 3,222,477 | A | * | 12/1965 | Lindell | 337/239 |
| 3,235,688 | A | * | 2/1966 | Fink et al. | 337/156 |
| 3,366,761 | A | * | 1/1968 | Smith, Jr. | 337/10 |
| 3,611,240 | A | * | 10/1971 | Mikulecky | 337/169 |
| 3,614,700 | A | * | 10/1971 | Beard et al. | 337/203 |
| 3,825,871 | A | * | 7/1974 | Blewitt | 337/171 |
| 3,827,010 | A | * | 7/1974 | Cameron et al. | 337/168 |
| 3,834,246 | A | * | 9/1974 | McGilp | 474/135 |
| 4,321,575 | A | * | 3/1982 | Koszewa et al. | 337/168 |
| 4,412,202 | A | * | 10/1983 | Russell et al. | 337/171 |
| 4,414,527 | A | * | 11/1983 | Biller | 337/180 |
| 4,546,341 | A | * | 10/1985 | McNaghten et al. | 337/177 |
| 4,774,488 | A | * | 9/1988 | Field | 337/171 |
| 4,824,279 | A | * | 4/1989 | Casazza | 403/294 |
| 5,274,349 | A | * | 12/1993 | Hassler et al. | 337/171 |
| 5,289,154 | A | * | 2/1994 | Davis | 337/169 |
| 5,760,673 | A | * | 6/1998 | Hassler et al. | 337/168 |
| 6,211,768 | B1 | * | 4/2001 | Cress et al. | 337/292 |
| 6,462,639 | B1 | | 10/2002 | Farag et al. | |
| 6,583,708 | B1 | | 6/2003 | Smith et al. | |
| 2010/0245023 | A1 | * | 9/2010 | Massingill | 337/171 |

* cited by examiner

WIRE-FUSE CIRCUIT-BREAKER PROVICED WITH A FUSEHOLDER AND A FUSE-BREAKER OF IMPROVED DRIVE AND OPERATION SAFETY

TECHNICAL FIELD

The present invention relates to a wire-fuse circuit-breaker provided with a fuseholder and a fuse-breaker for mechanically breaking the fuse wire.

It relates more particularly to the relative mounting of the fuse-breaker and the fuseholder on the circuit-breaker.

A particularly beneficial application of the device is its use in an overhead electrical distribution network typically rated at a voltage in the range 7 kilovolts (kV) to 38 kV.

PRIOR ART

Wire-fuse circuit-breakers including both a fuseholder housing an electric fuse in the form of a wire and a device usually referred to as a fuse-breaker for mechanically breaking the fuse wire are known in the art.

U.S. Pat. No. 6,583,708 B1 discloses a prior art wire-fuse circuit-breaker, for example.

FIGS. 1 and 1A are simplified views of part of a prior art wire-fuse circuit-breaker 1. It includes a fuseholder 2, a fuse-breaker with a drive lever 3, and a trunnion 4 on which the fuseholder 2 and the drive lever 3 are removably and pivotally mounted.

To be more precise, the fuseholder 2 includes a flange forming a base 20 at the bottom of a tube 21 with extensions 200 that pivot on the trunnion 4 via a shaft 201.

Thus the fuseholder 2 is mounted to pivot relative to the trunnion 4 via the shaft 201. It is opened as shown by the arrow O in FIG. 1A by pulling on an eyelet 22.

The fuse-breaker includes a drive lever 3 having an end that is formed as a hook 30 adapted to be actuated by pulling it toward the ground by means of a drive rod held by an operator when the circuit-breaker 1 is in an installed configuration and in a closed position to enable current to flow.

The drive lever 3 includes two arms 31, 32 and is removably and pivotally mounted on the trunnion 4 via a driving rod 6.

This driving rod 6 is mounted in pins 41 of the trunnion 4. The ends of the two arms 31, 32 of the drive lever 3 in which the rod 6 is mounted with a tight fit are inside the interior space of the trunnion 4 defined by the separation between the two pins 41 (FIG. 1A).

Another lever 7 that forms the breaking lever as such has a cylindrical portion 70 inside which the driving rod 6 is mounted with a tight fit. It also has a breaking portion 71 adapted to come into contact with and to stretch the fuse wire and an abutment portion 72 adapted to be mechanically-abutted with and to exert a thrust force on an abutment portion 202 of the base 20.

The drive lever 3, the driving rod 6 and the breaking lever 7 are therefore mounted to rotate together about the geometrical axis defined by the alignment of the two pins 41.

The breaking lever 7 is furthermore in contact with a return spring that is not shown and that has the function of preventing the lever 7 remaining in the gas evacuation area when the fuse wire melts. The spring also has the function of extracting the fuse wire from the tube when breaking low currents.

The trunnion 4 includes a threaded rod 40 onto which a nut 5 may be screwed, the tubular portion 42 on which the fuseholder 2 pivots relative to the trunnion 4 via the shaft 201, as explained above, and the pins 41 for pivoting about a lower support part of the device 1 that is not shown.

Accordingly, the pins 41 define a pivot axis relative to the support part (not shown) of the mechanical assembly consisting of the fuseholder tube 2, the fuse-breaker including the drive lever 3, the trunnion 4, the driving rod 6, the breaking lever 7 and the return spring (not shown) for the levers 3, 7.

The nut 5 is for mechanically fastening the fuse wire that is housed in the fuseholder tube 2 and enables current to flow between the two support parts (not shown) between which the fuseholder 2 is mounted in the closed position.

The operation of the prior art device 1 is described below with reference to mechanically breaking the fuse wire when required, but only under manual operation.

If an operator applies traction to the drive lever 3 in the direction of the arrow A in FIG. 1, that lever causes the breaking lever 7 to pivot about the driving rod 6. This causes the fuse wire, retained on the threaded rod 40 of the trunnion 4 by the nut 5, to be broken by the application of a stretching force by the portion 71 of the lever 7 that is in contact with the wire, stretches it, and thus breaks it.

The design of the circuit-breaker of FIGS. 1 and 1A is furthermore such that the end dome 23 of the fuseholder tube 2 remains in contact with the upper part of the support (not shown) and therefore does not open before the fuse wire is completely broken. Mechanical opening of the fuseholder tube 2 after the fuse wire is completely broken is brought about both by the trunnion 4 pivoting relative to the support 200 on the shaft 201 and by the trunnion 4 itself pivoting relative to the bottom jaw of the fuseholder support on the shaft 6 and pins 41 of the trunnion 4. This two-fold pivoting is possible only if the fuse wire is no longer applying tension between the trunnion 4 and the tube 2. This two-fold pivoting enables the bottom part of the tube 2 to swing forwards and downwards (turning about the shaft 6 as shown by the arrow A, which corresponds to the anticlockwise direction when the fuseholder is seen with the insulator on the right and the tube 2 on the left). On swinging, the tube 2 is no longer retained at the top by the dome-shaped leaf spring 22 and the whole of the tube swings about the trunnion 4 under its own weight. This creates an isolating distance between the upstream and downstream contacts and provides a visual indication that the fuse wire has actually broken.

Moreover, the abutment portion 72 of the breaking lever 7 is adapted to abut against the abutment portion 202 at the base 20 of the fuseholder 2. This holds all the parts in place if the fuse wire is not mechanically broken or does not melt.

In other words, the fuse-breaker device is designed to effect the following sequence when the lever 3 is operated:

- mechanical breaking of the fuse wire, thus breaking the current between the lower and upper parts of the support;
- once the current has been broken, pivoting of the fuseholder tube 2 away from the lower part of the support by separation between the end dome 23 and the upper part of the support, thus opening the electrical circuit.

The inventors have realized that a major risk remains in all devices of this type currently on sale.

This major risk is that when the operator actuates the drive lever 3 (as shown by the arrow A in FIG. 1) the fuseholder 2 may open relative to its support when it is still live (fuse wire not yet mechanically broken).

Clearly such an opening reaction is not the required operation and causes safety problems for the operator. Furthermore, it can cause problems on high-voltage and medium-voltage lines on which a circuit-breaker is installed.

The prior art device shown in FIGS. 1 and 1A also has the following disadvantages. By design, as explained above, the arms 31, 32 of the drive lever 3 have their ends inside the interior space of the trunnion 4 defined by the two pins 41 and extending below the fuseholder tube 2.

On actuating the drive lever 3, in order to prevent mechanical interference between said lever and the fuseholder tube 2 below it, it is necessary to provide a large clearance between them. This implies producing a lever 3 with a large gap between the arms 31, 32. In other words, the drive lever 3 is of complex shape and thus complicated to produce and always constitutes an obstacle to the evacuation of gases.

It might be thought that a solution to the problem of unintentional opening of the fuseholder relative to its support when it is still live has already been proposed in the document U.S. Pat. No. 4,774,488: the fuseholder 7 opens in the clockwise direction and the lever 30 for driving the fuse wire 12 is actuated in the anti-clockwise direction. Although the document itself explains that actuating the drive lever 30 does not exert any force on the other components of the device (see column 4, lines 23-27), that statement needs to be qualified. The shaft 33 on which the drive lever 30 pivots is fixed to the fastener socket 19 of the fuseholder 7 in a kind of cantilever arrangement and is separate from the pivot shaft 26 about which there pivot both the mechanical assembly, comprising the fuseholder 7, 8 with its socket 19, and the fuse-breaker, comprising the drive lever 35, the conducting element 21, the trunnions 27 and the breaking lever 25 as such.

Thus actuating the drive lever 30 can exert unintentional forces on the fuseholder 7, 8 and that might possibly open it.

The device of the above document also has another serious disadvantage: as shown in FIG. 3, some of the parts of the fuse-breaker for breaking the fuse wire are on one side of the fastener socket 19 of the fuseholder 8 while other parts are on the other side of the socket 19. To be more precise, the breaking lever 25 for breaking the fuse is mounted to pivot on one side of the socket 19 while the drive lever 30, the end 34 of which connecting the arms 31, 32, actuates the pivoting of the breaking lever 25, is mounted on the other side. This arrangement therefore implies that the arms 31, 32 of the drive lever 30 are below the tube 8. When breaking a current, proper exhausting of the blow-out gases is decisive for breaking to proceed correctly. Thus the presence of any component on the exhaust route creates turbulence that may cause the plasma to rise above the tube, which may cause a breakdown outside the tube between the downstream contact (situated above it) and the circuit-breaker support. Consequently, the presence of the arms 31, 32 of the lever 3 below the tube is unacceptable if the current is to be broken correctly, especially if breaking is not initiated by mechanical breaking by the fuse-breaker, because the arms may disturb the exhausting of the blow-out gases, which may result either in not actually breaking the fuse wire or in the conductive gas (plasma) rising up around the tube and consequently leading to arcing outside the fuseholder tube 8.

The object of the invention is therefore to propose a solution for a fuse wire circuit-breaker that alleviates the drawbacks of the prior art devices and that more particularly makes it possible to avoid both:

- any risk of the fuseholder reacting by opening when live if the drive lever is actuated in order to break the fuse wire mechanically;
- any risk of disturbing the exhausting of the blow-out gases and the gases rising up inside the fuseholder tube.

Another object of the invention is to propose a solution that is simple to implement and easy to fit.

A further object of the invention is to propose a solution that may be implemented in at least part of an existing circuit-breaker, particularly the part comprising the frame and the insulator, such as a porcelain insulator.

STATEMENT OF THE INVENTION

The above objects are achieved by mechanical assembly for a wire-fuse circuit-breaker, the assembly being adapted to be removably and pivotally mounted between two parts of a support of the circuit-breaker, the assembly including:

- a fuseholder tube adapted to accommodate a fuse wire and having an upper end that includes a dome adapted to close the tube, to enable the insertion of one end of the fuse wire, and to hold it in place, and having a lower end that is open to allow gases produced by breaking the fuse wire to exhaust, the fuseholder tube being adapted to be mounted to pivot between an open position in which it is in contact only with the lower part of the support and a closed position in which it is also in contact with and abutted against the upper part of the support;
- a fuse-breaker including:
  - a trunnion on which the fuseholder tube is pivotally mounted, including pins adapted to be removably mounted on the lower part of the support to enable pivoting of the mechanical assembly relative thereto, and means for fixing the other end of the fuse wire;
  - a drive lever mounted to pivot on the trunnion and adapted to be actuated by an operator;
  - a breaking lever mounted to pivot relative to the trunnion and adapted to be actuated by the drive lever and to stretch the fuse wire mechanically to break it;

in which assembly the direction of pivoting of the drive lever on the trunnion is the opposite of the direction of pivoting of the fuseholder tube and the mounting of the levers and the fuseholder tube on the trunnion leaves sufficiently clear the area in the vicinity of the open lower end of the tube regardless of the position of the levers and the tube in order to allow gases produced by breaking the fuse wire to exhaust without disturbing the flow thereof.

Thus the invention consists essentially in producing a relative mounting between the fuseholder and the fuse-breaker that is the opposite of that currently produced on existing circuit-breakers and that does not impede the evacuation of the gases for blowing out the arc when the fuse wire is broken. Thus mechanical actuation of the drive lever of the invention induces mechanical forces in the opposite direction to those necessary to open the fuseholder and no part impedes the area under the fuseholder tube necessary for the gases to exhaust on breaking a current.

In other words, when the operator drives the drive lever, and until the fuse wire breaks, the induced mechanical forces still contribute to retaining the fuseholder between the two conductive parts of the support. This is a simple mechanical way to provide a safety feature guarding against unintentional opening of the fuseholder when live.

According to an advantageous feature, the drive lever is of straight elongate shape with an arm arranged laterally relative to the trunnion and at a distance from the fuseholder tube. Thus, the drive arm is simple to produce and incorporate.

The drive lever preferably actuates the breaking lever by means of drive shaft fastened to the drive lever and mounted in the pins of the trunnion. Thus there is defined as it were a common axis for actuation of the fuse-breaker and pivoting of the trunnion and thus of the fuseholder tube in its support. In other words, there is direct mechanical interference between the support of the assembly and the fuse-breaker when the fuse-breaker pivots.

The drive shaft is preferably screwed to the drive lever.

A cam is advantageously mounted with a tight fit on the drive shaft and bearing against the breaking lever, the cam having an abutment portion adapted to abut against an abutment portion of the fuseholder tube and to cause it to pivot once the fuse wire has been broken. Accordingly, by actuating the drive lever, a moment is exerted directly on the breaking lever by means of the cam and the mechanical forces to be applied are therefore reduced compared to prior art solutions.

In one embodiment of the invention, a part is provided that is conformed to bear against the trunnion and on which the breaking lever is pivotally mounted, said part being fastened to the trunnion by the drive shaft that passes through it. This variant may be advantageous in configurations in which an existing circuit-breaker is to be renovated, requiring only drilling of the existing trunnion.

Alternatively, in a different embodiment, the breaking lever is mounted to pivot on the trunnion. This embodiment is advantageous because fewer parts are used as the breaking lever pivots directly on the trunnion.

The drive shaft preferably also constitutes the pivot shaft of the trunnion.

The invention provides a method of renovating a wire-fuse circuit-breaker including a fuseholder tube and fuse-breaker, wherein the following steps are executed:

a) dismantling a mechanical assembly comprising the fuseholder tube, a fuse-breaker including a drive lever adapted to be actuated by an operator, and a lever for breaking a fuse wire actuated by the drive lever, where actuation of the drive lever generates mechanical forces in the direction of pivoting of the fuseholder towards its open position in its support;

b) reassembling a mechanical assembly such as mentioned above.

Thus, the method of the invention makes it possible to achieve as it were interchangeability of part of a circuit-breaker in order to make the mechanical fuse-breaking driving of existing devices safe without any impact on the overall performance of the equipment.

In one embodiment of the invention, the mechanical assembly referred to in the step a) including a trunnion on which the drive and breaking levers and the fuseholder tube are pivotally mounted, wherein before the step b) a step a1) of modifying the trunnion is executed and the mechanical assembly is re-assembled with the trunnion modified as in step a1).

The step a1) may advantageously consist in drilling the trunnion.

The invention finally relates to use of a wire-fuse circuit-breaker including a mechanical assembly as described above for use in an overhead electrical distribution network, typically rated at 7 kV to 38 kV.

The drive lever is advantageously in a substantially horizontal position when the circuit-breaker is in the installed configuration and in the closed position.

The drive lever is advantageously on the right-hand side of the fuseholder tube relative to an operator below the circuit-breaker in the installed configuration and in the closed position.

The operator preferably actuates the lever by applying a traction force toward the ground.

BRIEF DESCRIPTION OF THE DRAWINGS

The invention can be better understood after reading the following detailed description given by way of non-limiting illustration and with reference to FIGS. 1 to 7, in which.

DETAILED DESCRIPTION OF PARTICULAR EMBODIMENTS

Only the mechanical parts of the fused circuit-breakers of the prior art and the invention that illustrate the invention are described in detail.

Figure 7:
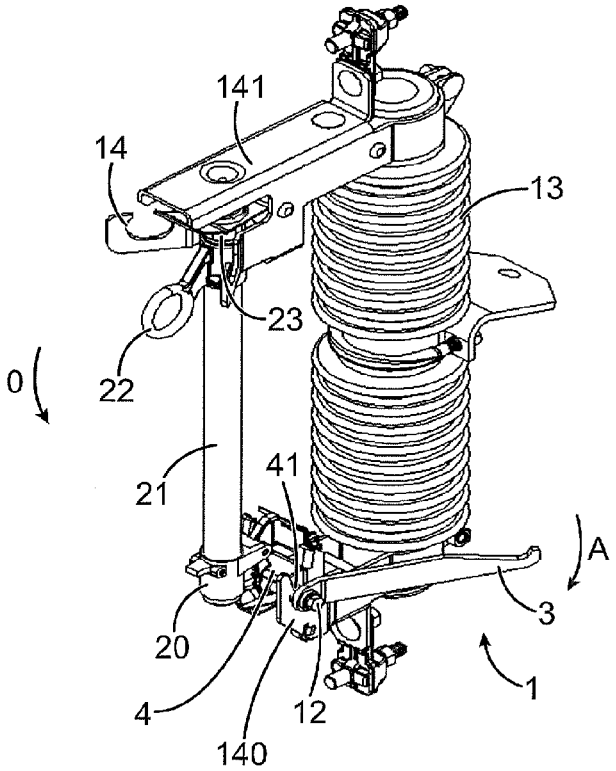
FIG. 7 is an isometric perspective view of a circuit-breaker of the invention in its installed configuration.

Thus the fuse wire, the fuseholder support, the insulator part, and the conductive terminals represented in FIG. 7 are not specifically described.

For greater clarity, reference may be had to all the technical documentation that describes all the parts and functions of a wire-fuse circuit-breaker used in a high-voltage overhead network, for example U.S. Pat. No. 6,583,708 B1.

For clarity, parts common to the prior art circuit-breaker (FIGS. 1 and 1A) and the circuit-breaker of the invention (FIGS. 2 to 7) carry the same references.

Throughout the present application, the terms "lower" and "upper" are to be understood with reference to the configuration of the circuit-breaker on its support, the drive lever being actuated by an operator pulling it downwards and the fuseholder tube being adapted to pivot downwards.

Figure 1:
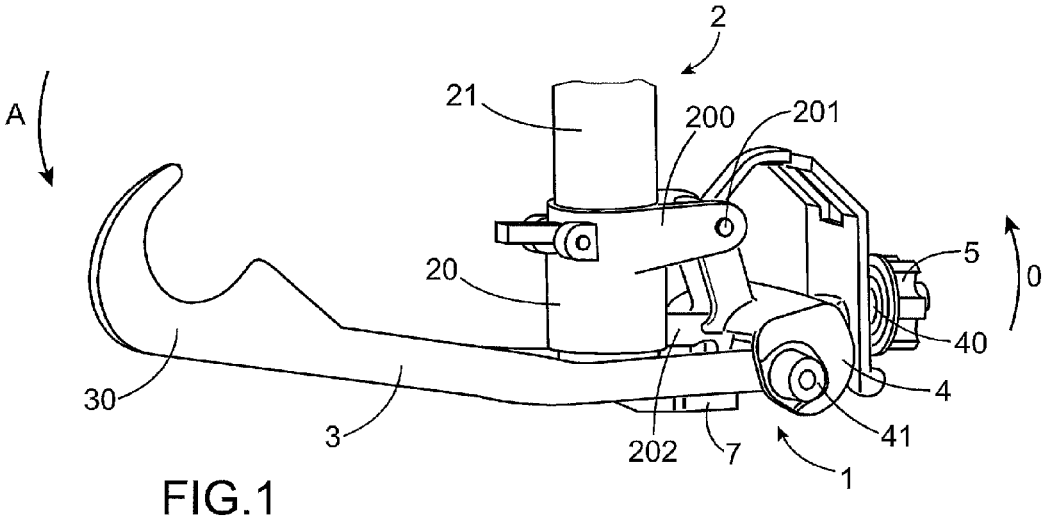
FIG. 1 is an isometric perspective view of a mechanical assembly of a prior art wire-fuse circuit-breaker.
Figure 1A:
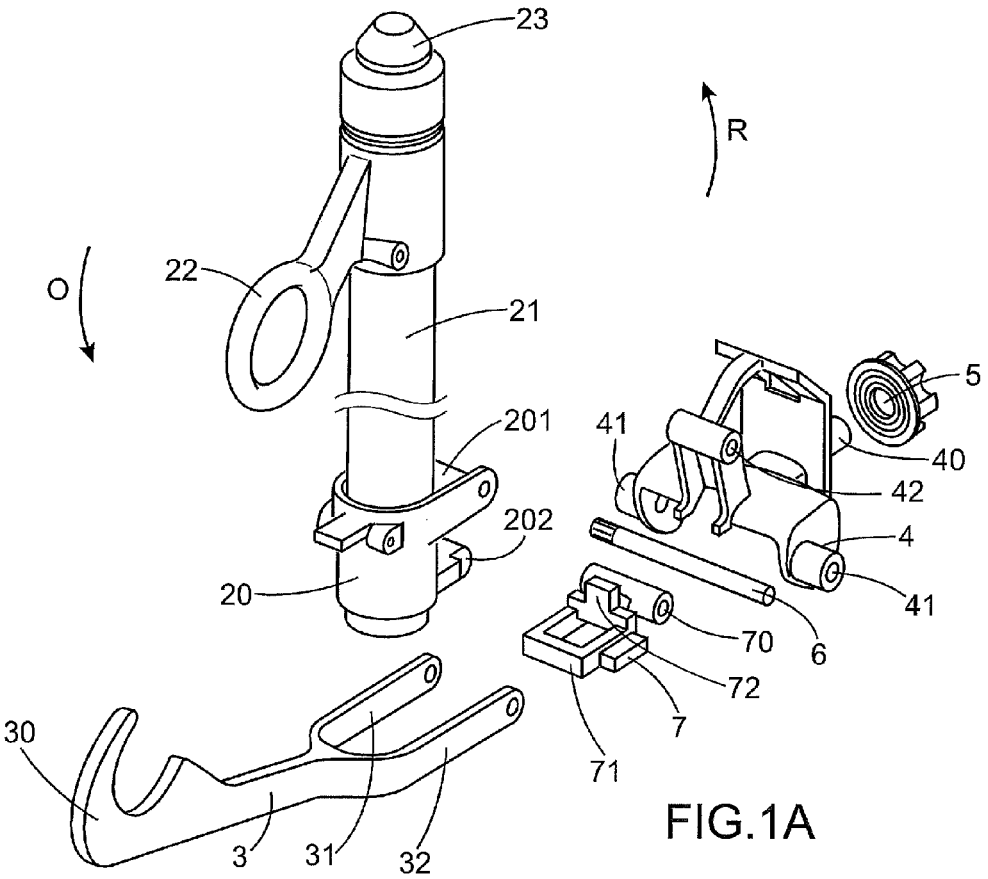
FIG. 1A is an isometric exploded perspective view of a mechanical assembly of the circuit-breaker from FIG. 1.

FIGS. 1 and 1A showing the prior art circuit-breaker have already been commented on in the preamble and are therefore not commented on here.

The inventors have found that there is a major risk when actuating the drive lever 3 of a prior art device as represented in FIGS. 1 and 1A. The forces or loads in the direction of the arrow A can cause a reaction of the trunnion 4 and therefore of the fuseholder 2 shown by the arrow R in FIG. 1, i.e. in the same direction as the opening direction O of the fuseholder 2. Electric current flows during this actuation and before the fuse wire is mechanically broken. In other words, the fuseholder is still live and opening it can therefore have harmful consequences.

Moreover, in a prior art circuit-breaker such as that disclosed in U.S. Pat. No. 4,774,488, the drive lever 30 and the breaking lever 25 are mounted in such a way that they are below the fuseholder tube. They therefore impede the exhausting of the gases resulting from extinguishing the arc caused by breaking the fuse wire.

This is why the inventors have produced a mechanical assembly as shown in FIGS. 2 to 6B in which mechanical actuation of the drive lever 3 does not cause any reaction by the trunnion 4 or the fuseholder 2 in the opening direction O and in which no mechanical part obstructs evacuation of the gases resulting from extinguishing the arc caused by breaking the fuse wire.

In other words, the mechanical assembly of the invention induces mechanical forces in the opposite direction to those necessary to open the fuseholder.

As in FIGS. 1 and 1A, the fuseholder tube 2 includes an end dome 23 adapted to close the tube, to enable the insertion of one end of the fuse wire, and to hold it in place, and the trunnion 4 includes a threaded rod 40 onto which is screwed a nut 5 which together constitute the means for fixing the other end of the fuse wire.

Compared to the prior art device, the circuit-breaker 1 of the invention further includes a cam 8 that is mounted with a tight fit on a drive shaft 6 that is itself fixed to the drive lever 3 by a screw 12.

Figure 2:
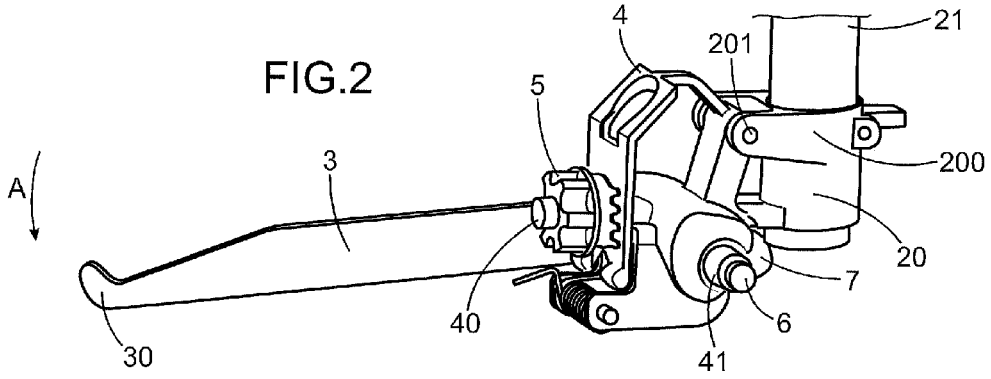
FIG. 2 is an isometric perspective view of a mechanical assembly of a wire-fuse circuit-breaker of a first embodiment of the invention.

In the embodiment of FIGS. 2', 2A and 5A, the breaking lever 7 is mounted to pivot on an additional locking part 9 that has a surface 9.1 that mates with an interior surface 410 of the trunnion 4. This part 9 further includes holes 90 through which the drive shaft 6 passes.

Moreover, the breaking lever 7 is spring-loaded toward the additional part 9 by a return spring 11 mounted on a rod 10 that is itself mounted in the part 9. This return spring 11 thus returns the breaking lever 7 and the drive lever 3 to their respective positions when no force is applied.

Pivoting the drive shaft 6 by actuating the drive lever 3 causes pivoting of the breaking lever 7 via the cam 8 but does not cause pivoting of the part 9.

In the embodiment of FIGS. 3, 4, 6A, and 6B, the breaking lever 7 is mounted to pivot on the trunnion 4 via the rod 10 around which the return spring 11 is mounted.

Figure 5A:
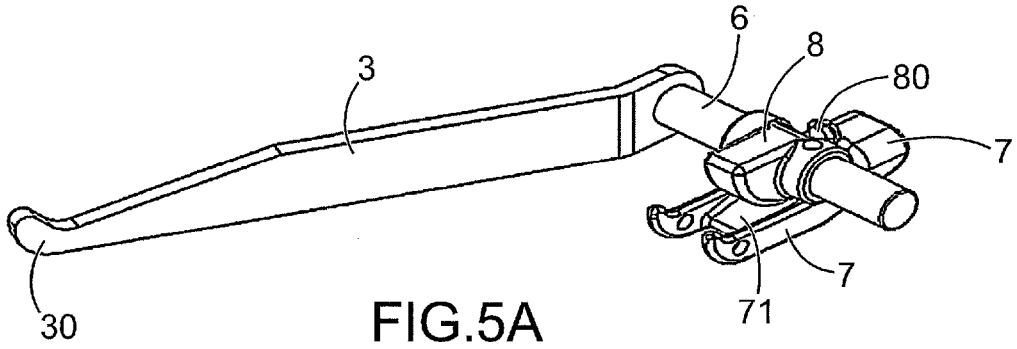
FIGS. 5A and 5B are isometric perspective views of part of a mechanical assembly of a wire-fuse circuit-breaker of the invention.

As seen better in FIG. 5A, the assembly of the invention makes it possible for the drive lever 3 to exert a moment directly on the breaking lever 7 via the cam 8.

Moreover, an abutment portion on the lever 7 (reference 80 in FIG. 5A and 72 in FIG. 5B) makes it possible in cooperation with an abutment portion 202 at the bottom of the tube to maintain said lever 7 in its initial position against the force exerted by the return spring and without exerting any force on the fuse wire.

Figure 5B:
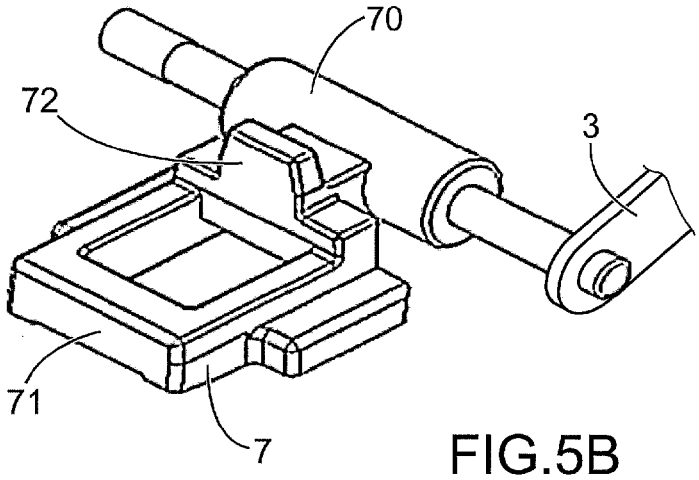

As seen better in FIG. 5B, there may be provision for mounting the drive shaft 6 on a tubular portion 70 of the breaking lever 7.

Figure 6A:
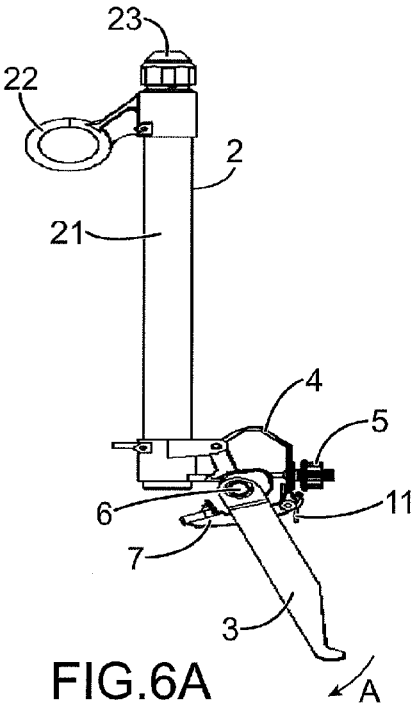
FIGS. 6A and 6B are a front view and a side view of the circuit-breaker of the second embodiment of the invention.
Figure 6B:
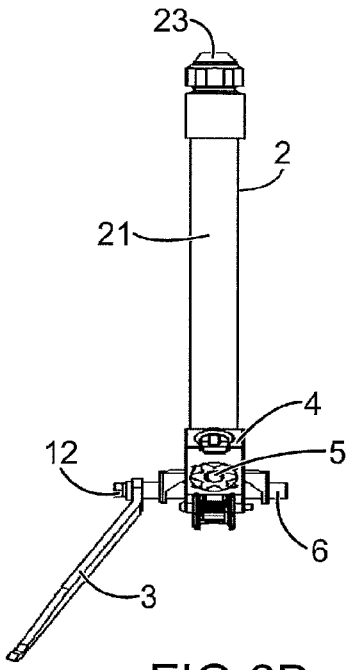

As seen better in FIGS. 6A and 6B, the drive lever 3 is of straight elongate shape with an arm arranged laterally relative to the trunnion 4 and at a distance from the tube 21 of the fuseholder 2.

Figure 2A:
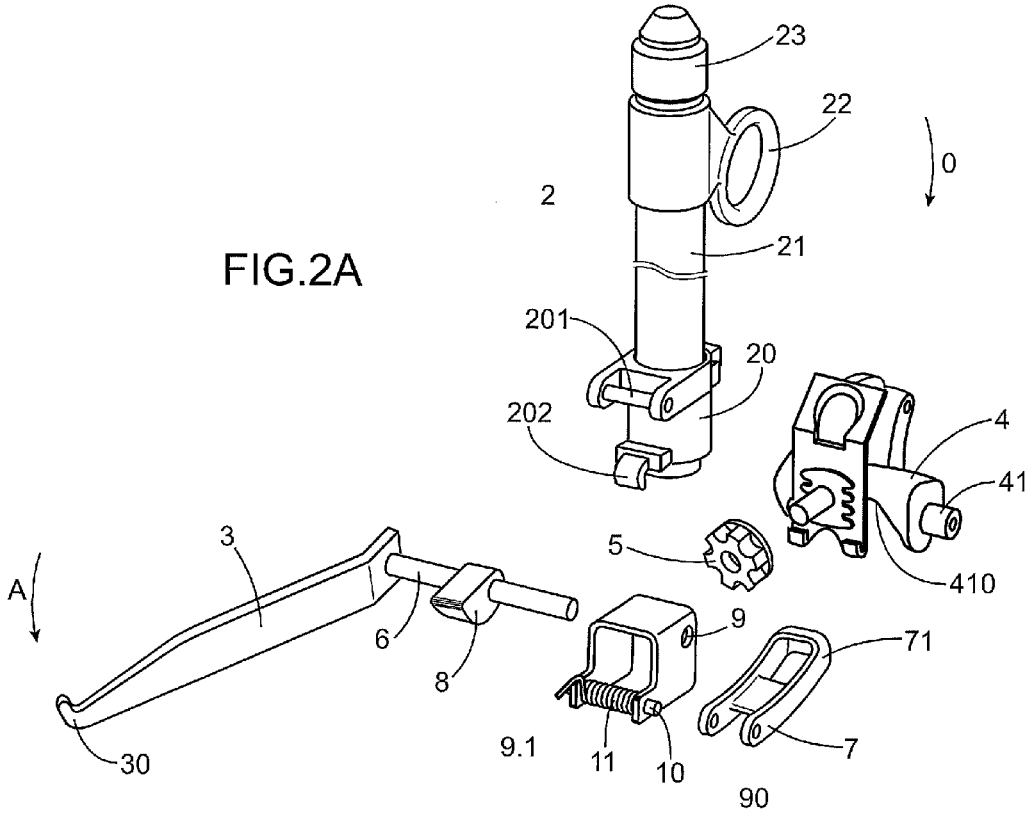
FIG. 2A is an isometric exploded perspective view of the circuit-breaker from FIG. 2.
Figure 3:
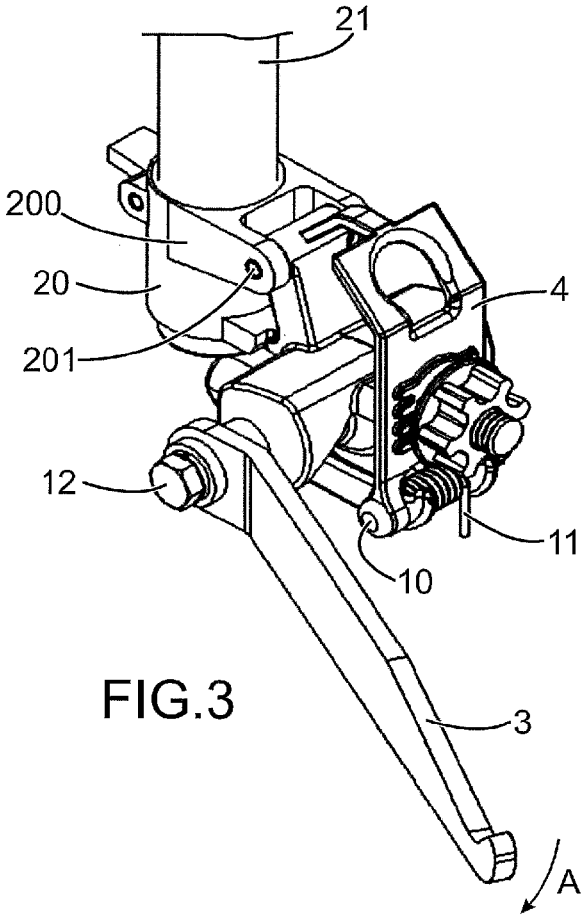
FIGS. 3 and 4 are isometric perspective views from different angles of a mechanical assembly of a wire-fuse circuit-breaker of a second embodiment of the invention.

In the embodiment of FIGS. 2, 2A, and 5A, on actuation of the drive lever 3 as shown by the arrow A, the cam 8 is rotated and causes the breaking lever 7 to pivot downward on the part 9. The pivoting of the breaking lever 7 in contact with the fuse wire stretches the wire until it breaks. The part 9 bearing against the interior 410 of the trunnion 4 is not moved and therefore causes no reaction by the trunnion 4 and the fuseholder 2 in the direction of opening thereof indicated by the arrow O.

In the embodiment of FIGS. 3, 4, and 6A, 6B, pivoting of the cam 8 by the drive lever 3 pivots the breaking lever 7 in the same direction A, which is the direction opposite the pivoting direction of the tube 21 of the fuseholder 2.

Figure 4:
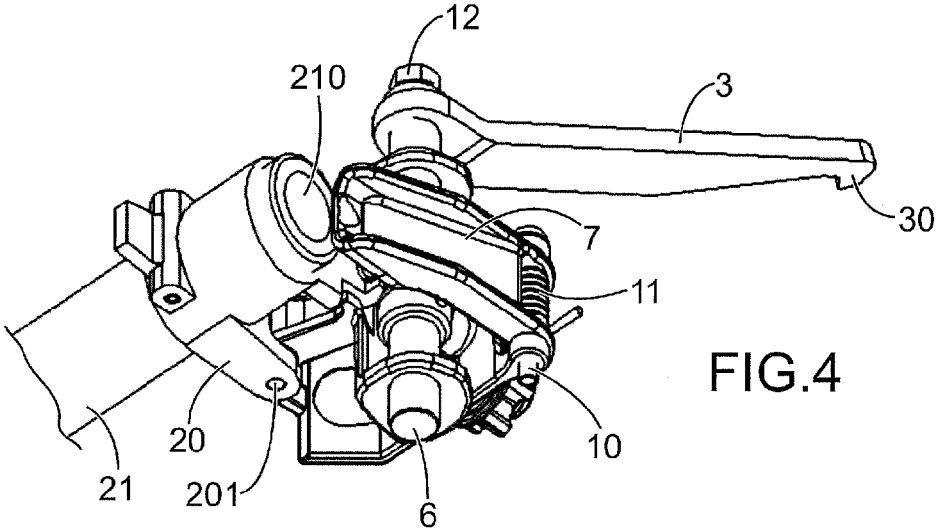

The lack of obstruction of the gases produced by extinguishing the arc caused by breaking the fuse wire is shown in FIG. 4, in which it is seen that none of the parts, in particular the breaking lever 7, faces the opening 210 of the tube 21 of the fuseholder 2.

In FIG. 7 there is shown a wire-fuse circuit-breaker including a mechanical assembly of the invention used in an overhead electrical distribution network, typically rated at 7 kV to 38 kV. This equipment essentially comprises, in the usual way, an insulator 13 and a support with two parts 140, 141.

The mechanical assembly of the invention is removably mounted between the two parts 140, 141 of the support, the pins 41 of the trunnion 4 or the drive shaft 6 being locked in the lower part 140 of the support while the end dome 23 is in the closed position of the tube 21 of the fuseholder 2, locked in the upper part 141 of the support.

Other improvements and variants may be made to the mechanical assembly described without departing from the scope of the invention.

For example, although the drive levers 3 described are actuated by an operator driving in the anticlockwise direction with the circuit-breaker seen from the front with the insulator on the right (FIG. 7), an operator driving in the clockwise direction with the device also seen from the front may be envisaged.

A drive lever conformed to be actuated by the operator by an upward pushing force may also be envisaged.

The invention claimed is:

1. A mechanical assembly for a wire-fuse circuit-breaker, the assembly being removably and pivotally mounted between two parts of a support of the circuit-breaker including an upper part and a lower part, the assembly comprising:

a fuseholder tube for accommodating a fuse wire with the fuseholder tube having an upper end that includes a dome for enabling one end of the fuse wire to be inserted and held therein and an open lower end through which-exhaust gas produced by breaking the fuse wire passes;

a fuse-breaker including:

a trunnion on which the fuseholder tube is pivotally mounted between an open position and a closed position, said trunnion including pins removably mounted on the lower part of the support to enable pivoting of the mechanical assembly relative thereto, and means for fixing an other end of the fuse wire;

a drive lever pivotally mounted on the trunnion and actuated by an operator; and a breaking lever that mechanically breaks open the fuse wire with the breaking lever being pivotally mounted relative to the trunnion;

wherein:

the levers and the fuseholder tube are mounted on the trunnion to leave open an area in the vicinity of the open lower end of the tube to allow gases produced by breaking the fuse wire to exhaust without disturbing the flow thereof; and with the fuse breaker further comprising;

a drive shaft mounted in the pins of the trunnion and fastened to the drive lever to form a common drive shaft between the trunnion and drive lever for actuating the breaking lever to break open the fuse wire; and a cam mounted on the drive shaft in a tight fit such that it rotates in concert with the pivoting movement of the drive lever and bears against the breaking lever such that upon actuating the drive lever the drive lever and the drive shaft pivots in a direction opposite to the direction of pivoting of the fuseholder tube with the cam rotating to cause the breaking lever to pivot in a direction opposite to the direction of pivoting of the drive lever.

2. A mechanical assembly according to claim 1, wherein the drive lever is of straight elongate shape with an arm arranged laterally relative to the trunnion and at a distance from the fuseholder tube.

3. A mechanical assembly according to claim 1, wherein the drive shaft is screwed to the drive lever.

4. A method of renovating a wire-fuse circuit-breaker having a mechanical assembly as defined in claim 1 including a fuseholder tube mounted on a trunnion and a fuse-breaker, wherein the following steps are executed:

a) dismantling the mechanical assembly of claim 1, comprising the fuseholder tube, with the fuse-breaker including a drive lever actuated by an operator, and a drive shaft mounted on the trunnion and fastened to the drive lever for forming a common drive shaft with the drive lever for breaking a fuse wire in response to the actuation of the drive lever, wherein actuation of the drive lever generates mechanical forces in the direction of pivoting of the fuseholder towards its open position in its support; and b) reassembling the mechanical assembly according to claim 1.

5. A renovation method according to claim 4, the mechanical assembly referred to in the step a) including a trunnion on which the drive and breaking levers and the fuseholder tube are pivotally mounted, wherein before the step b) a step a1) of modifying the trunnion is executed and the mechanical assembly is re-assembled with the trunnion modified as in step a1).

6. A renovation method according to claim 5, wherein the step a1) consists in drilling the trunnion.

7. Use of a wire-fuse circuit-breaker including a mechanical assembly according to claim 1 in an overhead electrical distribution network rated at 7 kV to 38 kV.

8. Use according to claim 7, wherein the drive lever is in a substantially horizontal position when the circuit-breaker is in the installed configuration and in the closed position.

9. Use according to claim 7, wherein the drive lever is on a right-hand side of the fuseholder tube relative to an operator below the circuit-breaker in the installed configuration and in the closed position.

* * * * *